United States Patent [19]

Dickson, Jr. et al.

[11] 4,160,457

[45] Jul. 10, 1979

[54] TOOL JOINT CLEANER

[75] Inventors: Leon L. Dickson, Jr.; Early B. Denison, both of Houston, Tex.

[73] Assignee: Shell Oil Company, Houston, Tex.

[21] Appl. No.: 846,750

[22] Filed: Oct. 31, 1977

[51] Int. Cl.[2] ..... B08B 3/02; B08B 9/02

[52] U.S. Cl. ..... 134/167 C; 134/172; 134/199

[58] Field of Search ..... 134/167R, 167 C, 168 R, 134/168 C, 199, 22 C, 24, 138–139, 172, 183, 198, 179

[56] References Cited

U.S. PATENT DOCUMENTS

| | | | |
|---|---|---|---|
| 1,521,390 | 12/1924 | Reynolds | 134/199 UX |
| 2,543,993 | 3/1951 | Stanitz et al. | 134/139 X |
| 2,642,034 | 6/1953 | Griffin et al. | 134/167 R X |
| 2,735,794 | 2/1956 | Pletcher | 134/179 X |
| 2,764,991 | 10/1956 | Baggett | 134/167 C |
| 2,985,178 | 5/1961 | Christensen, Jr. | 134/199 X |
| 3,312,231 | 4/1967 | Monroe et al. | 134/24 X |
| 3,407,099 | 10/1968 | Schell | 134/199 X |

*Primary Examiner*—Robert L. Bleutge

[57] ABSTRACT

A portable, hand-held cleaner for cleaning the box and pin ends of a joint of drill pipe using only high-pressure water. The cleaner includes a tubular housing having a plurality of spray nozzles disposed to create a swirling water jet that thoroughly cleans the threads and mating shoulders of the box and pin without requiring the use of solvents or mechanical means, such as brushes.

3 Claims, 4 Drawing Figures

TOOL JOINT CLEANER

BACKGROUND OF THE INVENTION

The present invention relates to a tool joint cleaner, particularly a cleaner that is adapted to clean both the box and pin ends of a section of drill pipe on a drill rig. Further, the cleaner is designed to use only normal drilling water and does not require the use of solvents or other cleaning agents that would contaminate the drilling fluid.

U.S. Pat. Nos. 4,011,617 and 4,014,062 show and describe cleaners for cleaning the box and pin ends of drill pipe. The cleaners illustrated in these patents both utilize a solvent for cleaning the threads of the box and pin ends of the drill pipe. Since the box and pin ends of the drill pipe are cleaned directly over the borehole, the solvent used as a cleaning agent will contaminate the drilling fluid in the borehole. This is undesirable since the composition of the drilling fluid is closely controlled to obtain optimum drilling results. In particular, most drilling fluids are either water-based or oil-based; and in either case, solvents will seriously contaminate the drilling fluid. In addition, if hydrocarbon solvents are used, they can cause pollution and/or a safety hazzard.

The use of solvents as a cleaning agent for the drill pipe is also undesirable when using a drill string telmetry system such as that described in application Ser. No. 753,768, filed Dec. 23, 1976. In this type of telemetry system, information is sent from the bottom of the borehole to the surface over a hard wire system. Each section of the drill pipe is provided with a conduit containing a wire which terminates in contact rings disposed in the sealing shoulders of the drill pipe. When the drill pipe is made up, the contact rings seat and complete the circuit from one section of the drill pipe to the next section. The use of solvents to clean the box and pin ends of the drill pipe introduces the possibility of creating short circuits in the contact rings.

In addition to the above disadvantages, the cleaners described in the above patents also require the use of rotary brushes to assist the cleaning action. The use of rotary brushes necessitates drive means which increases the weight of the cleaning apparatus and requires the use of auxiliary means for supporting the cleaning apparatus. This reduces the flexibility of the cleaning apparatus and increases the time required for cleaning the tool joint.

BRIEF DESCRIPTION OF THE INVENTION

The present invention is based on the discovery that the box and pin ends of a section of drill pipe can be satisfactorily cleaned using high-pressure water and proper positioning of jet nozzles. In particular, the nozzles are positioned to create a swirling action in the water. The swirling action of the water rotates around the threads of the box and pin ends and thoroughly cleans the threaded joints while flushing out the dirt and grease.

Since the cleaner uses only water jets, the cleaning device may be made relatively small and light-weight. This permits the operator to hand-hold the device and readily move about on the drilling rig floor to clean the box or pin ends. Thus, considerable time is saved since the box end of the pipe joint may be cleaned while the drill string is held in the slips on the rig floor or while a joint is in the mouse hole and other operations are being done by the hoisting equipment. Also, it is possible to clean the pin end of the drill pipe as the drill pipe is moving from a rack position to a position over the borehole. Thus, the cleaning operation does not materially add to the time required to remove the drill string from the borehole and replace it or to the time required to add a joint to the drill string.

Since water is used as the cleaning agent, the drilling water available on the rig may be used and no contamination of the drilling fluid will result. Normally, the amount of water required to clean a box end is 1.5 gallons and the total amount of water required to clean the boxes on 10,000 feet of drill pipe, on a normal trip, will only dilute the drilling mud approximately ½ percent (assuming a 8¾" borehole diameter). This dilution will not materially affect the composition of the drilling mud.

DESCRIPTION OF THE DRAWINGS

The invention will be more easily understood from the following detailed description of a preferred embodiment when taken in conjunction with the attached drawings in which.

PREFERRED EMBODIMENT

Figure 1:
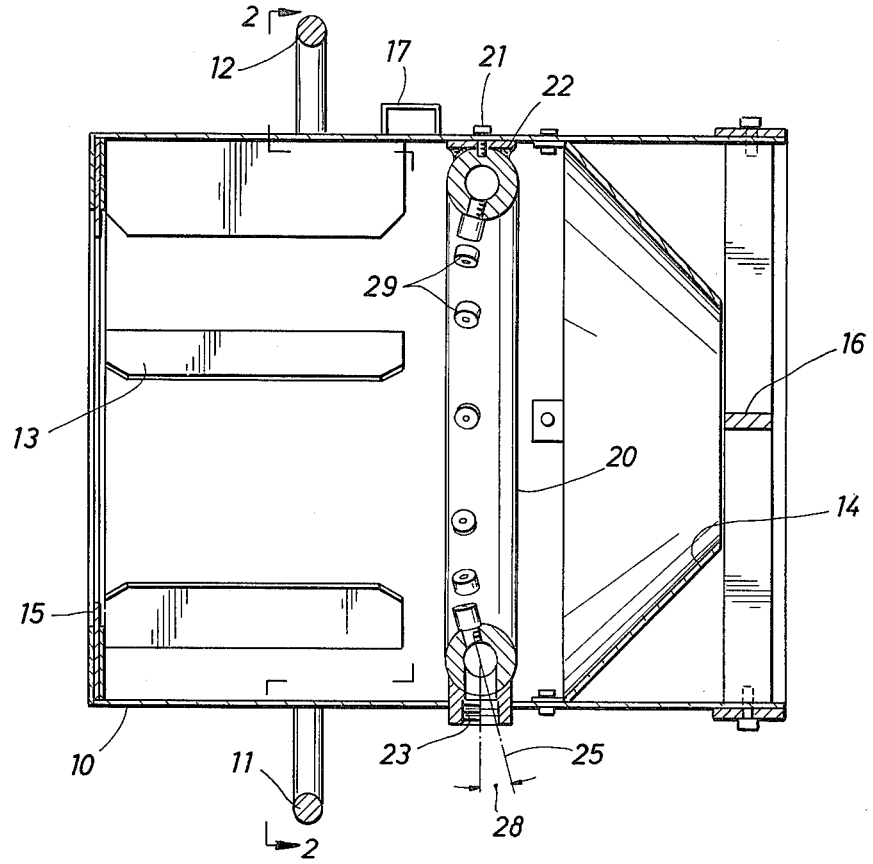
FIG. 1 is an elevation view, shown in section, of the cleaner used for cleaning the pin end of the drill pipe.
Figure 2:
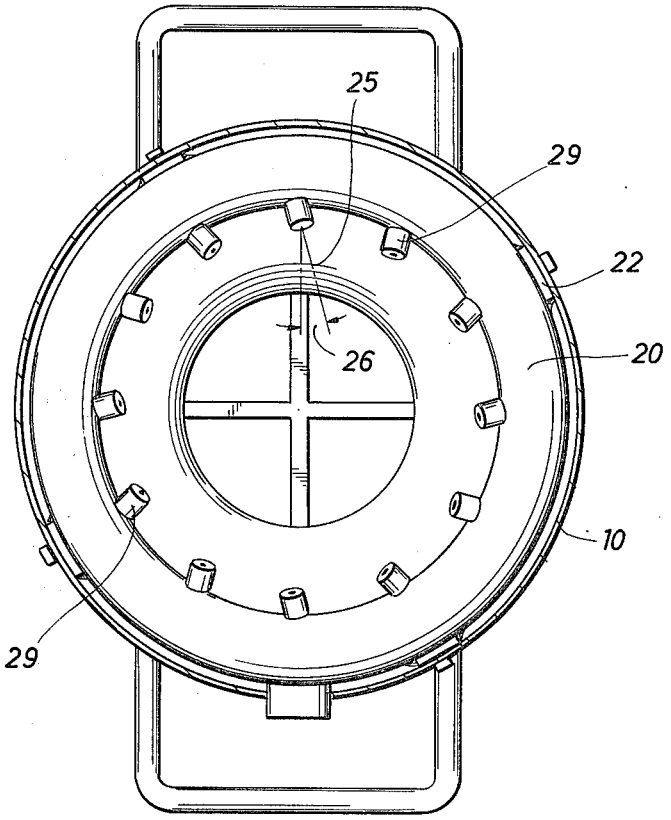
FIG. 2 is an end view of the pin cleaner shown in FIG. 1.

Referring now to FIGS. 1 and 2, there is shown the details of the cleaner for the pin ends of the drill string. The cleaner includes an outer cylindrical housing 10 that is open at both ends, preferably formed of thin metal to reduce the overall weight of the device. The housing is provided with two diametrically opposed handles 11 and 12 that are used by the operator to position the cleaner over the pin end of the drill pipe and move the cleaner. A series of circumferentially spaced webs 13 are positioned around the interior of the housing at the upper end, as shown, and serve as guide means to guide the cleaner onto the pin end of the drill pipe. The opposite end of the housing is provided with deflector cone 14 that serves to deflect the cleaning water into the interior of the cleaner. This insures that the cleaning water exits from the bottom end of the cleaner in a small stream and limits the area that is subjected to the wetting by the water and splashing of the operator. A rubber splash shield 15 is positioned at the upper end, as shown, to limit the amount of spray which exits from the top of the cleaner when it is being used. The rubber gasket material seals against the pin OD and protects the operator from the jets of water. The cleaner is also provided with a stop 16 at its lower or right-hand end, as shown, which consists of two flat bars securely fastened to the housing 10. The cleaner is provided with switch means 17, which is convenient to the handle 12, in order that the operator may control the flow of pressurized water to the jet nozzles. The switch may comprise a simple electrical switch by which the operator can control an electrical flow control valve disposed on the discharge end of the high-pressure pump.

The spray head consists of a manifold or spray ring 20, which is securely attached at its outer periphery to the housing 10. The manifold may be attached by a series of cap screws 21 which thread into bosses 22 formed on the periphery of the spray ring. It should be noted that the manifold has a relatively heavy wall in order that suitable mounting positions for the individual jet nozzles may be provided. The high-pressure fluid inlet 23 is formed on the outer periphery of the manifold by means of a boss or similar means. A plurality, for example 12, of jet mounting surfaces are formed on the inner periphery of the manifold. The mountings consist of flats which are machined on the inner periphery of the manifold and are disposed at an angle to both a radius of the manifold and a plane passing through the center of the manifold. For example, as shown in the top view of the cleaner, the axis 25 of the nozzle is disposed at an angle 26 to a radius of the manifold which passes through the center of the mounting surface. This creates a swirling flow pattern to flush out the dirt and grease. If the angle is omitted, dirt and grease accumulate inside the housing 10. Similarly, as shown in the elevation view, the axis 25 is also disposed at an angle 28 with respect to a plane which passes through the center of the manifold. This angle insures good cleaning of the mating face (sealing shoulder) of the pin joint. The angles 26 and 28 may vary over a wide range but excellent results have been achieved when both angles are 15 degrees. The use of 15-degree angles insures that the high-pressure fluid produces a swirling action as it exits from individual jet nozzles to thoroughly clean the threads of the pin joint. An individual jet nozzle 29 is mounted in each of the mounting surfaces and may comprise a commercial jet nozzle which is suitable for use with high-pressure fluids. We have successfully used 25-degree fan nozzles, such as Part No. 1/8VV2502, available from American Aero, Houston, Texas, or from Spraying Systems Company, Wheaton, Illinois. The long axis of the fan pattern is set parallel to the plane of the manifold or ring to give full circumferential coverage of the threads and mating face.

In operation, the cleaner is coupled to a source of high-pressure fluid which, on a drilling rig, may be ordinary drill water supplied at a pressure of approximately 1800–2400 psi and 12–15 gallons per minute. Production tubing connections may require 5000–7000 psi for good cleaning. As explained above, the switch means 17 controls the flow of high-pressure water to the cleaner. High-pressure water supplied to the cleaner will exit from the individual jet nozzles 29 in a swirling or circulating flow pattern having sufficient pressure and flow to thoroughly clean the individual threads and mating face of the pin joint of all debris. Moving the cleaner up and down with a slight rotation insures cleaning all the threads and the mating face. This cleaning action is especially important to the drill string telemetering system described in the above-referenced application. In this telemetering system, special nonconducting drill pipe lubricants are used, and it is mandatory that the threads be clean to prevent a buildup of the nonconducting lubricant and metal slivers on the contact ring surfaces built into the mating faces. By removing the thread lubricant from the threads of the pin end, it is prevented from accumulating and forcing its way upward over the contact ring disposed in the sealing shoulder of the pin joint.

Figure 3:
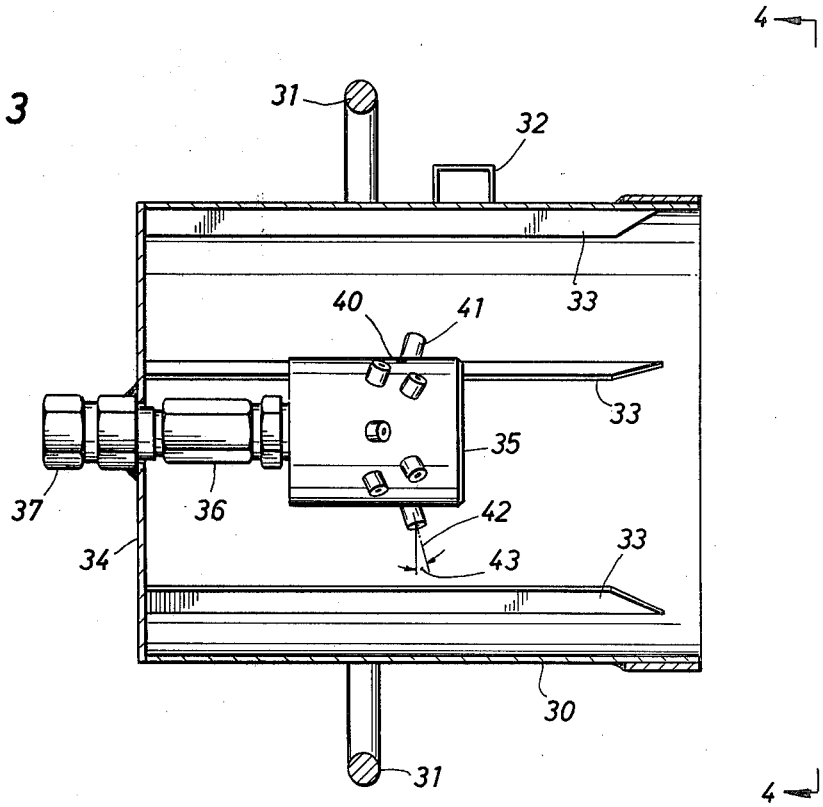
FIG. 3 is an elevation view, shown in section, of the cleaner used for the box end of the drill pipe.
Figure 4:
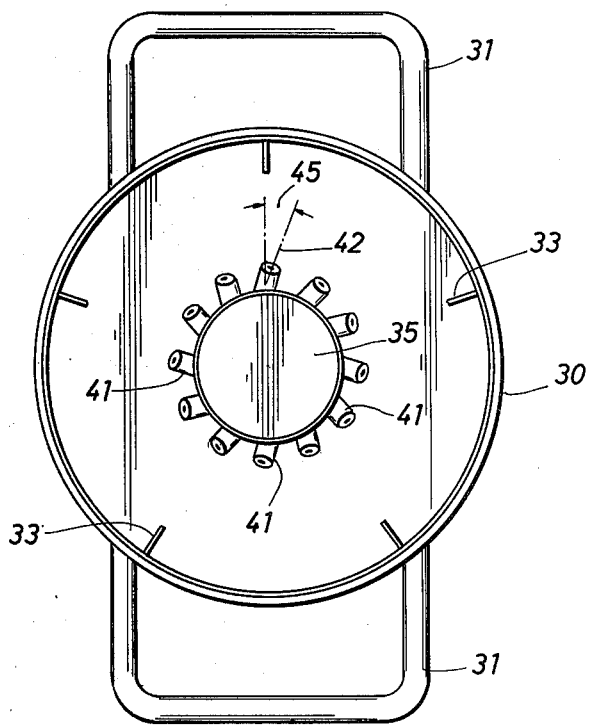
FIG. 4 is an end view of the box cleaner shown in FIG. 3.

Referring now to FIGS. 3 and 4, there is shown a cleaner that is similar in construction to that described above but with the use of a spray head instead of the manifold to permit the cleaning of box ends of a drill pipe. The box cleaner utilizes a cylindrical outer housing 30 having diametrically opposed handles 31. A switch means 32 is mounted adjacent one of the handles so that the operator may control the flow of high-pressure water to the cleaner. The interior of the housing is provided with a series of radially spaced guide members 33 that may consist to this members which are welded to the inner surface of the cylindrical housing. The upper end of the housing is closed by a plate 34 which is welded to the housing. The spray head 35 is mounted on the axis of the cylindrical housing and projects down to approximately the midpoint of the housing. The spray head is coupled by means of a pipe 36 to the inlet 37 of the cleaner with a source of high-pressure water being coupled to the inlet 37. The combination of the pipe 36 and inlet 37, in addition to providing fluid communication with the spray head, also serve to support the spray head. As shown in the drawing, the spray head has a series of jet nozzle mounting flats 40 machined around the periphery of its outer surface. Due to the small diameter of the spray head, it is necessary to machine two rows of mounting surfaces on the spray head with each row having six surfaces. This permits the mounting of twelve jet nozzles in the spray head to insure that the threads and mating face of the box end of the pipe joint are thoroughly cleaned. As shown in the elevation view, the axis 42 of the jet nozzle 41 are inclined downwardly at an angle 43. The jet nozzles of the second row are also inclined downwardly with the angles of inclination of both rows being chosen so that the streams from both rows of jets converge at the threads of the box joint. Normally, the average angle between the two rays will be about 15 degrees. This downward inclination insures good cleaning of the mating face (sealing shoulder) of the box joint. Similarly, as shown in FIG. 4, the nozzle axes 42 are disposed at an angle 45 to the radius of the spray head 35. This creates a swirling flow pattern to flush out the dirt and the grease. This angle can vary, but 15 degrees has been found to work well.

The box cleaner is operated in substantially the same manner as the pin cleaner described above. The source of high-pressured water is coupled to the inlet of the box cleaner, and the operator controls its flow by the switch mounted adjacent the handle on the box cleaner. The same fan nozzles are used as with the pin cleaner, and the long axis of the fan pattern is set parallel to the plane of the top closure plate 34. Utilizing the box cleaner, the operator places the cleaner over the box end of the joint of drill pipe and moves it axially along the drill pipe in an up and down manner with a slight rotation. The flow of high-pressured water from the jet nozzles will completely remove all the debris from the threads and mating face of the box joints.

In normal drilling operations, while making a trip, it is convenient to clean the boxes while tripping out of the borehole. The cleaning is done with the drill string held in the rotary table by the slips while the crew is waiting for the elevators to descend from the top of the derrick. Thus, no lost time is incurred. The pins can be cleaned while tripping into the borehole. First, the stand must be picked up from the pipe rack; then, the pin is cleaned; and finally, it is mated to the box in the rotary table. This pin cleaning operation does involve lost rig time but it is minimal since most of the operation can be completed while the stand is being moved from the pipe rack to the rotary.

What is claimed is:

1. A hand-held cleaner for cleaning the pin ends of a tubular member using a source of high-pressure liquid as the cleaning medium, said cleaner comprising:

a tubular housing, said housing having at least one open end for receiving said tubular member;

handle means secured to the exterior of said housing for use by an operator;

a circular tubular manifold, said manifold being mounted in the interior of said tubular housing with the plane of the manifold being substantially at right angles to the axis of said housing;

a plurality of jet nozzles mounted on said manifold with their discharge openings pointed inwardly, the axis of said nozzles being disposed at an angle of 15 degrees to radii of said housing to create a swirling flow pattern and at an angle of 15 degrees to the plane of the manifold;

means for coupling the source of high-pressure liquid to said manifold; and, control means mounted on said handles for operation by said operator, said control means being disposed to control the flow of the high-pressure liquid.

2. A hand-held cleaner for cleaning the box ends of a tubular member using a source of high pressure liquid as the cleaning medium, said cleaner comprising:

a cylindrical housing having an open end for receiving said box end and its opposite end being closed;

handle means secured to the exterior of said housing for use by an operator;

a tubular support member mounted on the closed end of said housing and projecting along the axis of the housing;

a spray head coupled to the end of said tubular support;

a plurality of jet nozzles mounted on said spray head with their discharge openings projecting outwardly, said nozzles being mounted in two separate rows with their discharges directed at an angle to a plane perpendicular to said tubular member, the angle of each row being chosen so that the discharge of both rows converge at approximately the thread diameter of the box end and the axis of said nozzles, in addition, being disposed at an angle of 15 degrees to the radii of said nozzle head; and, means for coupling the source of high pressure fluid to said tubular support member.

3. The apparatus of claim 1 or 2 wherein twelve nozzles are used.

* * * * *